United States Patent [19]

Washington

[11] 4,063,374

[45] Dec. 20, 1977

[54] GRAVE OPENING AND CLOSING MACHINE

[76] Inventor: Corinthian Washington, P.O. Box 646, Mansfield, La. 71052

[21] Appl. No.: 747,316

[22] Filed: Dec. 3, 1976

[51] Int. Cl.[2] ..... E02F 5/22

[52] U.S. Cl. ..... 37/142.5; 37/DIG. 6; 214/138 C; 214/146.5

[58] Field of Search ..... 37/142.5, DIG. 6, 103, 37/2 R, 183 R–188; 214/146.5, 138 C, 131 A, 138 R, 147 R; 294/70, 88

[56] References Cited

U.S. PATENT DOCUMENTS

| | | | |
|---|---|---|---|
| 2,334,323 | 11/1943 | Gilbert | 214/146.5 |
| 2,754,977 | 7/1956 | Przybylski | 37/DIG. 6 X |
| 3,524,510 | 8/1970 | Connell | 37/DIG. 6 X |
| 3,550,294 | 12/1970 | Fewell | 37/DIG. 6 |
| 3,577,664 | 5/1971 | Sing et al. | 37/DIG. 6 |
| 3,589,766 | 6/1971 | Bormioli | 37/183 R X |
| 3,775,876 | 12/1973 | May | 37/2 R |
| 3,987,563 | 10/1976 | Baur | 37/DIG. 6 X |

FOREIGN PATENT DOCUMENTS

| | | | |
|---|---|---|---|
| 2,220,883 | 11/1973 | Germany | 37/DIG. 6 |

*Primary Examiner*—E. H. Eickholt

*Attorney, Agent, or Firm*—Clarence A. O'Brien; Harvey B. Jacobson

[57] ABSTRACT

A wheeled vehicle is provided including a plurality of plan area peripheral portions. A generally horizontal support beam is pivotally supported from the vehicle with one end of the beam projecting outwardly of one peripheral portion of the vehicle and vertical oscillation of the one end of the beam relative to the vehicle. A first motor is connected between the beam and the vehicle for effecting selected angular displacement of the beam relative to the vehicle and an upstanding support structure is pivotally supported at its upper end from the one end of the beam for angular displacement relative to the beam about a horizontal axis extending transversely of the beam. A downwardly opening clam-type digging head is carried by the lower end of the support structure and a second motor is connected between the beam and the support structure for angularly displacing the support structure relative to the beam.

9 Claims, 5 Drawing Figures

5
36
32
28
34
24
10
54
52
62
58
56
24
40
50
42
40
38
26
26
48
60
64
44
66
72
68
14
16
18
96
4
94
92
20
46
70
98
92
98
80
90
96
98
5
92
90
4
76
90
78
74
94

50
66
64
72
70
68
98
78
74
98
80
98
76
82
82
88

GRAVE OPENING AND CLOSING MACHINE

BACKGROUND OF THE INVENTION

Various forms of mobile structures have been heretofore provided for the purpose of opening and closing graves. However, most of these structures are of a type rendering them difficult to maneuver in cemeteries between grave plots and others include digging structure which renders a grave digging operation difficult. Accordingly, a need exists for a mobile grave digging apparatus having high mobility and which may also be utilized to efficiently dig a grave.

Examples of previously known grave diggers and other excavating equipment including some of the general structural and operational features of the instant invention are disclosed in U.S. Pat. Nos. 2,770,057, 3,191,982, 3,344, 539, and 3,669,285.

BRIEF DESCRIPTION OF THE INVENTION

The grave digging apparatus of the instant invention utilizes a mobile frame of the self-powered type and which may be readily driven throughout a cemetery with ease and at a rate of speed at least equal to the speed of other forms of vehicular traffic which may occur in a cemetery. The grave digger is further constructed in a manner whereby it may be readily maneuvered into position for digging a grave and is further provided with grave digging structure operative in a reasonably quiet manner and to dig a grave of substantially retangular plan shape and including substantially vertical sides.

The main object of this invention is to provide a grave digging apparatus which may be readily maneuvered into a desired grave digging position.

Another object of this invention is to provide a grave digger of a highly maneuverable type and which may be readily driven, in a self-propelled manner, from one grave site to another at speeds equivalent to at least average vehicular speed in a cemetery. Still another object of this invention is to provide a grave digging apparatus which may be operated in a reasonably quiet manner to dig a grave.

Yet another important object of this invention is to provide a grave digger which will be capable of digging a grave of substantially rectangular plan shape and which includes substantially vertical sides.

A further object of this invention is to provide a grave digger which may be operated by personnel having only a minimum amount of experience in operation of the grave digging apparatus.

A final object of this invention to be specifically enumerated herein is to provide a grave digger in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
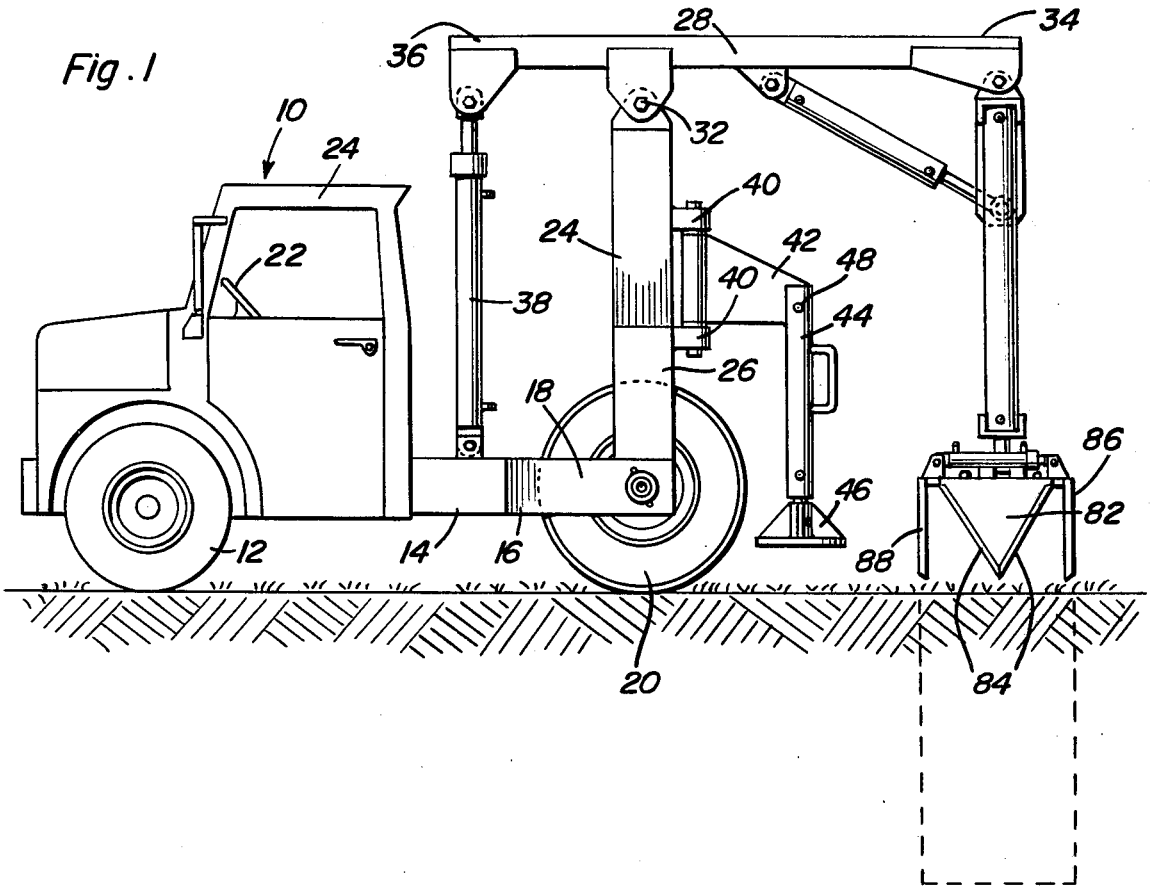
FIG. 1 is a side elevational view of the grave digging apparatus of the instant invention with the grave digging head thereof in position to dig a grave.
Figure 2:
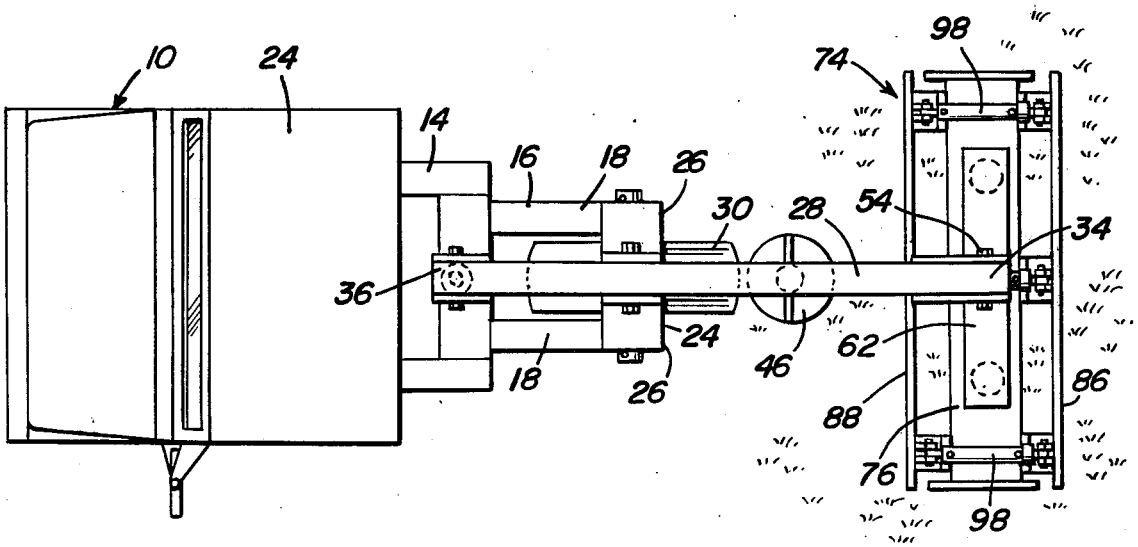
FIG. 2 is a top plan view of the assemblage illustrated in FIG. 1.

Referring now more specifically to the drawings, the numeral 10 generally designates the grave digging apparatus of the instant invention. The apparatus 10 includes a mobile vehicle having steerable and drivable wheels 12 at one end thereof, and a horizontally outwardly projecting frame portion 14 at the other end thereof. The frame portion 14 includes a bifurcated outer end 16 between whose furcations 18 a single and centrally disposed wheel 20 is journaled. The wheels 12 comprise opposite side wheels and may be steered by a conventional steering wheel 22 located in the operator's cab 24 of the vehicle 10.

The bifurcated end portion 16 of the frame portion 14 includes an upstanding support 24 whose lower end is bifurcated and includes opposite side furcations 26. The lower ends of the furcations 26 are anchored and supported from the free ends of the furcations 18.

A horizontal beam 28 is pivotally supported, intermediate its opposite ends, from the upper end of the support 24 for oscillation about a horizontal transverse axis as at 32 and one end 34 of the beam 28 projects horizontally outwardly of the end of the vehicle 10 remote from the wheels 12. The other end 36 of the beam 28 overlies the frame portion 14 and an extendable fluid motor 38 is connected between the frame portion 14 and the other end 36 of the beam 28 whereby oscillation of the beam 28 in a vertical plane may be effected by operation of the motor 38.

The support 24 includes a pair of vertically spaced journaled blocks 40 between which the inner end of a horizontally outwardly projecting arm 42 is pivotally mounted for oscillation of the arm 42 about a vertical axis. The outer end of the arm 42 has a vertically extendable landing leg assembly 44 supported therefrom and the lower end of the landing leg assembly 44 includes a horizontally enlarged foot 46 for engagement with the ground. The upper end of the landing leg assembly 44 is pivotally attached to the arm 42 as at 48 and the landing leg assembly 44 comprises a hydraulic cylinder which may be actuated to downwardly extend the foot 46.

Figure 3:
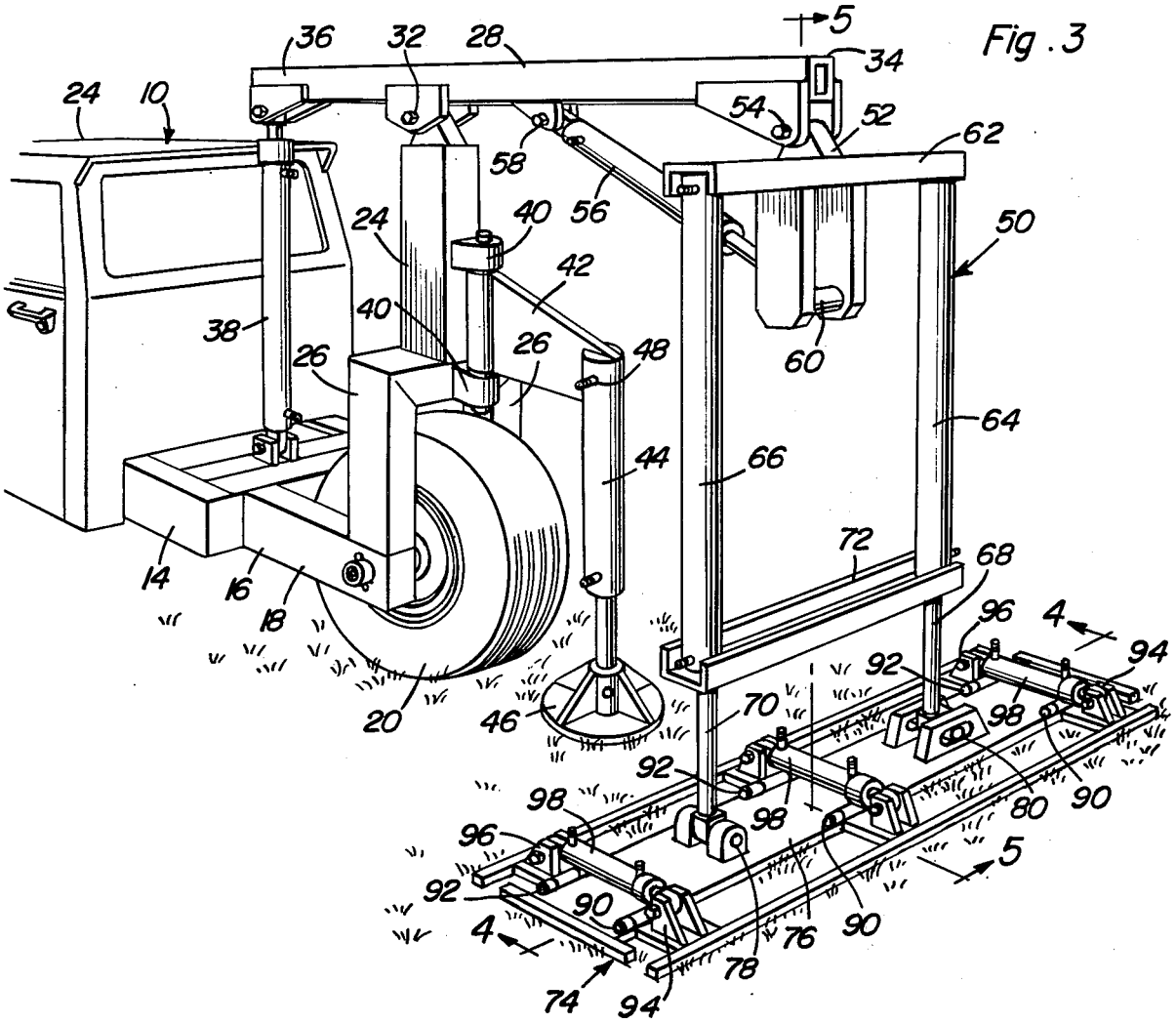
FIG. 3 is a fragmentary, perspective view of the grave digging apparatus with the grave digging structure thereof in position making the initial thrust into the ground to dig a grave.
Figure 4:
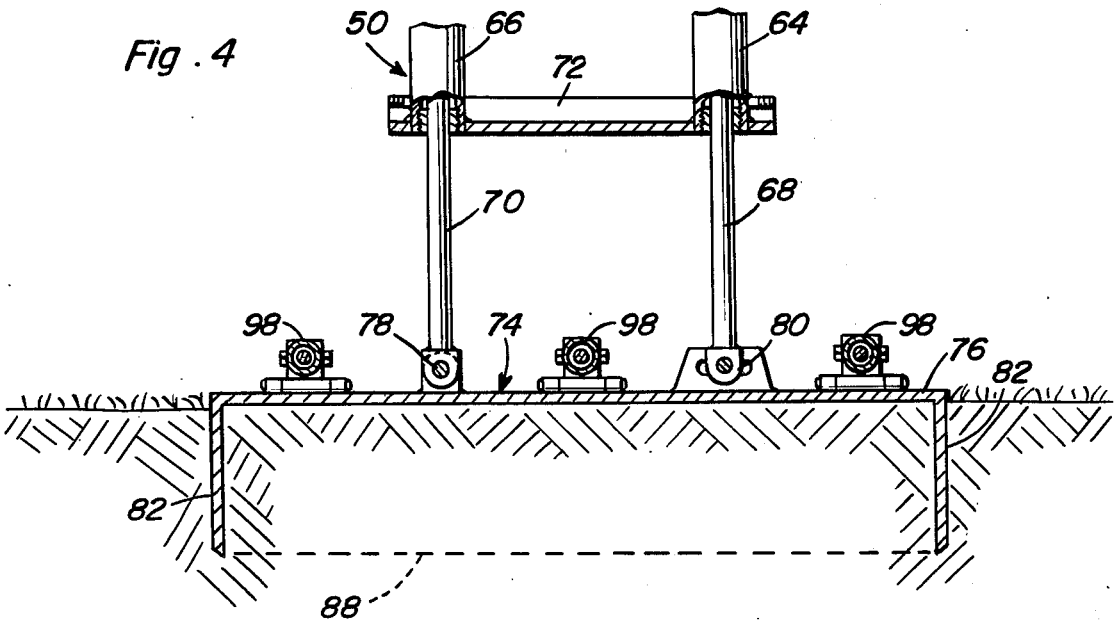
FIG. 4 is an enlarged, fragmentary vertical sectional view taken substantially upon the plane indicated by the section line 4—4 of FIG. 3.

With attention now invited more specifically to FIG. 3 of the drawings, an upstanding support structure referred to in general by the reference numeral 50 is provided and includes an upper mounting portion 52 which is pivotally supported from the outer end 34 of the beam 28 as at 54 for oscillation of the support structure 50 about a horizontal transverse axis. An inclined extendable fluid motor 56 has its opposite ends pivotally connected to the beam 28 as at 58 and to the support structure 50 as at 60 whereby the fluid motor 56 may be extended and retracted to oscillate the support structure 50 in a vertical plane about a horizontal, transverse axis. The support structure 50 includes an upper transverse member 62 from which the mounting portion 52 is supported and a pair of depending opposite side hydraulic cylinders 64 and 66 including downwardly extendable and upwardly retractable lower end piston rod portions 68 and 70. A lower transverse brace 72 corresponding to the brace 62 extends between and rigidly connects the lower ends of the cylinders 64 and 66 and the lower ends of the piston rods 68 and 70 support a downwardly opening clam-type digging head referred to in general by the reference numeral 74 therefrom. The digging head 74 includes an elongated horizontally disposed mounting portion 76 to one end portion of which the lower end of the piston rod 70 is pivotally secured as at 78. The lower end of the piston rod portion 68 enjoys a pin and slot-type pivotal connection 80 with the other end of the mounting portion 76.

Figure 5:
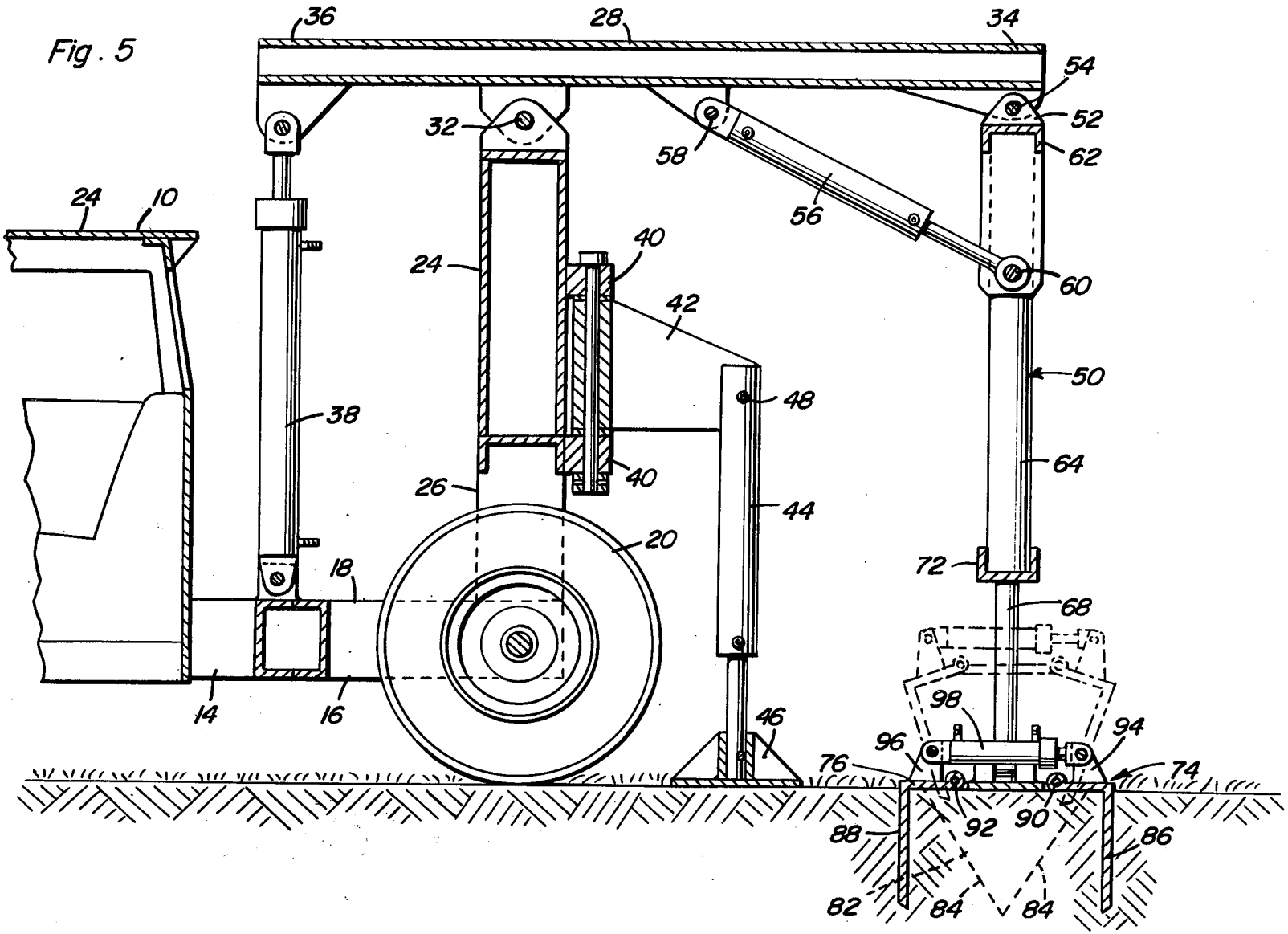
FIG. 5 is an enlarged, fragmentary longitudinal vertical sectional view taken substantially upon the plane indicated by the section line 5—5 of FIG. 3.

The opposite ends of the mounting portion 76 include depending transverse triangular digging blades 82 including sharpened downwardly convergent cutting edges 84 and the opposite side longitudinal portions of the elongated mounted portion 76 include depending cutting blades 86 and 88 pivotally supported therefrom as at 90 and 92. The blades 86 and 88 include upwardly projecting mounting portions 94 and 96 between which a plurality of extendable and retractable fluid motors 98 are connected whereby the digging blades 86 and 88 may be swung between the vertical positions thereof illustrated in FIG. 5 and downwardly convergent positions as a result of extension of the fluid motors 98 with the blades 86 and 88 generally paralleling corresponding pairs of the digging edges 84 of the blades 82.

As hereinbefore set forth, the vehicle 10 may be driven by an operator from within the cab 24. The wheels 12 comprise both driving and steering wheels and the vehicle 10 may be driven in either direction.

After the vehicle 10 has been moved into position with the grave to be dug immediately beneath the digging head 74 in the manner illustrated in FIG. 1 of the drawings, the arm 42 is swung to the desired position and the landing leg assembly 44 (comprising an extendable fluid cylinder) is actuated to lower the foot 46 into contact with the ground. Then, the cylinders or fluid motors 38, 56, 64, 66 and 98 may be actuated in order to drive the digging head 74 downward into the ground and to cause the digging blades 86 and 88 to swing toward downwardly convergent positions whereby the portions of the ground disposed between the blades 82, 86 and 88 may be lifted from the ground. Repeated operation of the digging head 74 in this manner will, of course, enable a suitable size grave to be dug.

The digging head assembly 74 may have an effective length between the blades 82 of substantially 8 feet and an effective width between the blades 86 and 88 of substantially 3 feet. Of course, the digging head 74 may be operated to dig a hole in the ground of at least 4 feet in depth.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a wheeled vehicle including a plurality of peripheral portions, a generally horizontal support beam pivotally supported from said vehicle with one end thereof projecting outwardly of one peripheral portion of said vehicle and vertical oscillation of said one end of said beam relative to said vehicle, first motor means connected between said beam and said vehicle for effecting selected angular displacement of said beam relative to said vehicle, an upstanding support structure pivotally supported at its upper end from said one end of said beam for angular displacement relative thereto about a horizontal axis extending transversely of said beam, a downwardly opening clam-type digging head carried by the lower end of said support structure, second motor means connected between said beam and said support structure for angularly displacing the latter relative to the former, said support structure including a pair of parallel elongated and independently longitudinally extendible upstanding support members suitably rigidly interconnected at their upper end portions for swinging in unison about said horizontal transverse axis and with said support members spaced apart in a direction paralleling said axis, said head including an elongated mounting portion paralleling the axis of oscillation of said support structure relative to said one end of said beam, said mounting portion including opposite side longitudinal marginal portions having depending digging blades supported therefrom for angular displacement about axes extending longitudinally of said longitudinal marginal portions, motor means operatively connected between said depending blades for pivoting the latter toward downwardly convergent positions, the lower end portions of said support members being pivotally anchored to longitudinally spaced midportions of said mounting portion of said head for oscillation relative thereto by pivot connections defining axes of oscillation extending transversely of said mounting portion and disposed at generally right angles relative to said support members and said horizontal transverse axis, one of said pivot connections including means operative to allow shifting of the corresponding axis relative to and longitudinally of said head.

2. The combination of claim 1 wherein the other end of said beam projects outwardly of the side of the horizontal axis of oscillation of the beam relative to the vehicle remote from said one end of said beam, said first motor means comprising an upstanding hydraulic cylinder pivotally connected between said other end of said beam and said vehicle.

3. The combination of claim 1 wherein said support members include upper and lower relatively extendable and retractable end portions and motor means operatively connected between said upper and lower end portions for effecting relative extension and retraction thereof.

4. The combination of claim 1 wherein said elongated mounting portion includes opposite end depending transverse blades.

5. The combination of claim 4 wherein said transverse blades include downwardly convergent cutting edges.

6. The combination of claim 1 wherein said vehicle includes a pair of opposite end portions and a pair of opposite side steerable and drive wheels disposed at one end of the portion of said vehicle, said one end of said beam projecting endwise outwardly of the other end of said vehicle.

7. The combination of claim 6 wherein said other end of said vehicle includes a single centrally located support wheel.

8. The combination of claim 6 wherein said other end of said vehicle includes a horizontal arm having one end portion thereof supported from said vehicle for angular displacement about an upstanding axis, the other end of said arm having a depending and downwardly extendable landing leg assembly supported therefrom.

9. A grave digger including a vehicle, a downwardly opening clam-type digging head, means supporting said head from said vehicle for vertical shifting relative thereto outwardly of one marginal side of said vehicle, said head including an elongated horizontal mounting portion opposite side marginal portions having depending parallel generally rectangular digging blades supported therefrom for angular displacement about axes extending longitudinally of said mounting portion, motor means operatively connected between said depending blades for pivoting the latter toward downwardly convergent positions, said elongated mounting portion including fixed opposite end depending transverse blades, said transverse blades including downwardly convergent cutting edges which closely parallel the upstanding end edges of said rectangular blades when the latter are disposed in their downwardly convergent positions.

* * * * *